US006699088B2

(12) United States Patent
Gokan

(10) Patent No.: US 6,699,088 B2
(45) Date of Patent: Mar. 2, 2004

(54) ENGINE MOUNT STRUCTURE FOR PERSONAL WATERCRAFT

(75) Inventor: Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,744

(22) Filed: Jun. 19, 2002

(65) Prior Publication Data

US 2003/0017768 A1 Jan. 23, 2003

(30) Foreign Application Priority Data

Jul. 19, 2001 (JP) ..... 2001-219324

(51) Int. Cl.[7] ..... B63H 16/04
(52) U.S. Cl. ..... 440/111
(58) Field of Search ..... 440/111

(56) References Cited

U.S. PATENT DOCUMENTS 6,227,922 B1 * 5/2001 Ochiai ..... 440/89 R
6,413,130 B2 * 7/2002 Hattori ..... 440/88 R

FOREIGN PATENT DOCUMENTS

JP 10252440 A 9/1998

* cited by examiner

*Primary Examiner*—Jesus D. Sotelo
(74) *Attorney, Agent, or Firm*—Birch, Stewart, Kolasch & Birch, LLP

(57) ABSTRACT

An engine mount structure for a personal watercraft allows the engine to be incorporated in an inclined well-balanced state in the watercraft body having a hull and a deck, while making efficient use of the space within the body. The engine for driving a jet propulsion pump has an upper case and a lower case joined along a transverse plane parallel to the engine crankshaft and is mounted in the body so as to be inclined about the crankshaft, whereby an intake port side of the engine faces obliquely upwardly. Mounts on upwardly facing intake side of the engine are provided on the lower case, while mounts on the downwardly facing exhaust side are provided on the upper case. A starter motor is attached to the upwardly facing side of the engine.

2 Claims, 9 Drawing Sheets

ENGINE MOUNT STRUCTURE FOR PERSONAL WATERCRAFT

CROSS-REFERENCE TO RELATED APPLICATIONS

The present application claims priority under 35 U.S.C. 119 of Japanese Patent Application No. 2001-219324 filed on Jul. 19, 2001, the entire contents thereof being hereby incorporated by reference.

BACKGROUND OF THE INVENTION

1. Field of the Invention

This invention relates to an engine mount structure for a personal watercraft. More particularly, the present invention relates to an engine mount structure for a personal watercraft wherein an engine for driving a jet propulsion pump is incorporated in a body having a hull and a deck.

2. Description of Background Art

Conventionally, a two-cycle engine is incorporated in personal watercraft that are in widespread use. The engine is disposed in such a posture that a cylinder thereof stands substantially upright at the center of the body of the watercraft.

In recent years, interest in using a four-cycle engine in a personal watercraft has been increasing because of the benefits of reducing exhaust gas pollution and noise.

However, since the four-cycle engine has a greater overall engine height when compared with the two-cycle engine, because of the structure of the cylinder head, even if the cylinder capacity is equal, it is difficult to incorporate the four-cycle engine in a small body of a personal watercraft in such a posture that the cylinder thereof stands substantially upright.

Thus, a personal watercraft has already been proposed wherein a 4-cycle engine is incorporated in a body in such a state wherein it is inclined to one side around the crankshaft thereof (the official gazette of Japanese Patent Laid-Open No. Hei 10-252440).

SUMMARY AND OBJECTS OF THE INVENTION

Usually, an engine has an upper case and a lower case joined along a transverse plane parallel to the crankshaft of the engine. However, in a conventional engine, a mount portion thereof is provided, both at the left and the right thereof, on the lower case.

Therefore, there is a problem that, if the engine (particularly a four-cycle engine) is installed in the body in a state wherein it is inclined to one side about the crankshaft thereof, then it is difficult to mount the engine in a well-balanced state in the body, or the mount portion (for example, a mount arm portion) must have an increased size, which uses small and precious space in the body and makes it difficult to arrange parts of ancillary mechanisms or parts for the intake and exhaust systems.

An object of the present invention resides in solution of such a problem as described above to provide an engine mount structure for a personal watercraft by which an engine can be incorporated in a well-balanced state in a body and the space in the body can be utilized efficiently.

In order to attain the object of the invention described above, an engine mount structure for a personal watercraft is provided wherein an engine for driving a jet propulsion pump is incorporated in the inside of a watercraft body having a hull and a deck, and the engine has an upper case and a lower case which are joined along a transverse plane parallel to a crankshaft of the engine. The engine is mounted in a state wherein the engine is inclined to one side about the crankshaft, and mount portions of the engine that attach to the body are provided at the left and the right of the engine on the upper case and the lower case.

To attain another object of the invention, the engine mount structure for a personal watercraft allows the engine to be mounted in an inclined relationship such that an intake port side is positioned on the upper side thereof while an exhaust port side is positioned on the lower side thereof, and the mount portions provided on the intake port side are provided on the lower case while the mount portions on the exhaust port side are provided on the upper case.

To attain another object of the invention, the engine mount structure for a personal watercraft is used with an engine provided with a supercharger, and an intercooler connected to the supercharger and a surge tank are connected to the intake port.

To attain another object of the invention, the engine mount structure for a personal watercraft is used with an engine having a starter motor for starting the engine attached to the upper case, and the mount portions on the side to which the starter motor is attached are provided on the lower case.

With the inventive engine mount structure for a personal watercraft, the engine for driving the jet propulsion pump is incorporated in the watercraft body surrounded by the hull and the deck. The engine has the upper case and the lower case joined along a transverse plane parallel to the crankshaft of the engine and is mounted in a state wherein it is inclined to one side about the crankshaft. Mount portions of the engine that attach to the body are provided at the left and right sides of the engine on the upper case and the lower case, whereby the engine can be incorporated in a well-balanced condition in the body in an attitude inclined to one side about the crankshaft thereof.

Further, since the mount portions can be made compact, ancillary mechanisms or parts for the intake and exhaust systems can be disposed utilizing the small and precious intra-body space effectively.

Also, with the inventive engine mount structure for a personal watercraft, the engine is mounted in an inclined state such that the intake port side thereof is positioned on the upper side and the exhaust port side thereof is positioned on the lower side. The mount portions on the intake port side are provided on the lower case and the mount portions on the exhaust port side are provided on the upper case, whereby the space above the mount portions on the lower case side is wide and equipments for the intake system or a member can be disposed to make effective use of the space.

Particularly where the engine is an engine with a supercharger and the intercooler connected to the supercharger and the surge tank are connected to the intake port of the engine, the intercooler and the surge tank can be accommodated in the wide space above the mount portions on the lower case side. Accordingly, such an engine mount structure is particularly effective where the engine is provided with a supercharger.

With the inventive engine mount structure for a personal watercraft, the starter motor for starting the engine is provided on the upper case and the mount portions on the side on which the starter motor is mounted are provided on the lower case. Consequently, the starter motor can be disposed near the engine without interfering with the mount portions, and the engine weight including the starter motor can be concentrated in the proximity of a central portion of the watercraft body, and the cornering performance of the boat can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9(*b*) is a bottom plan view of the engine block.

DETAILED DESCRIPTION OF THE PREFERRED EMBODIMENTS

Figure 1:
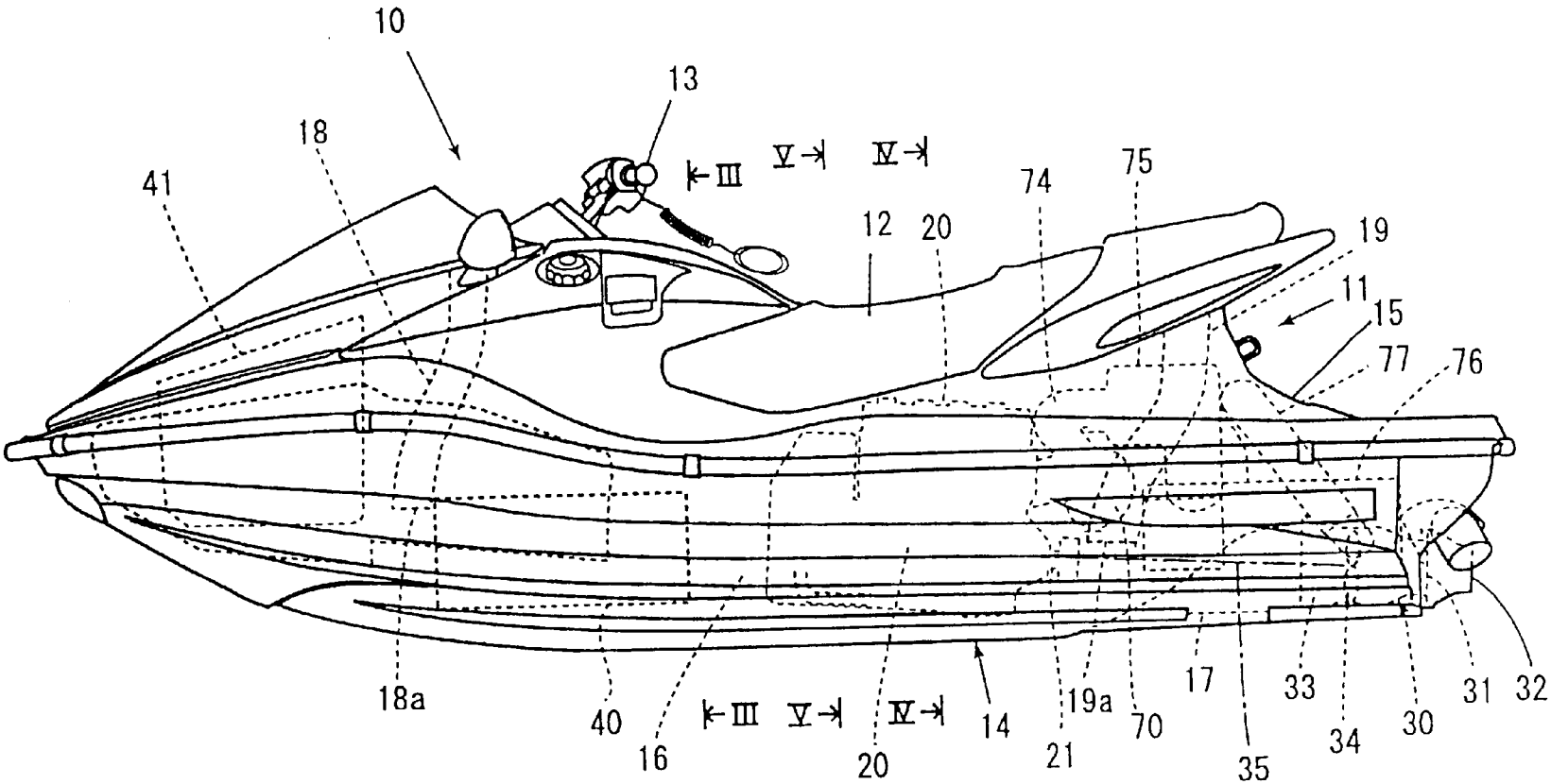
FIG. 1 is a schematic side elevational view showing an example of a personal watercraft which employs an embodiment of an engine mount structure for a personal watercraft according to the present invention.
Figure 2:
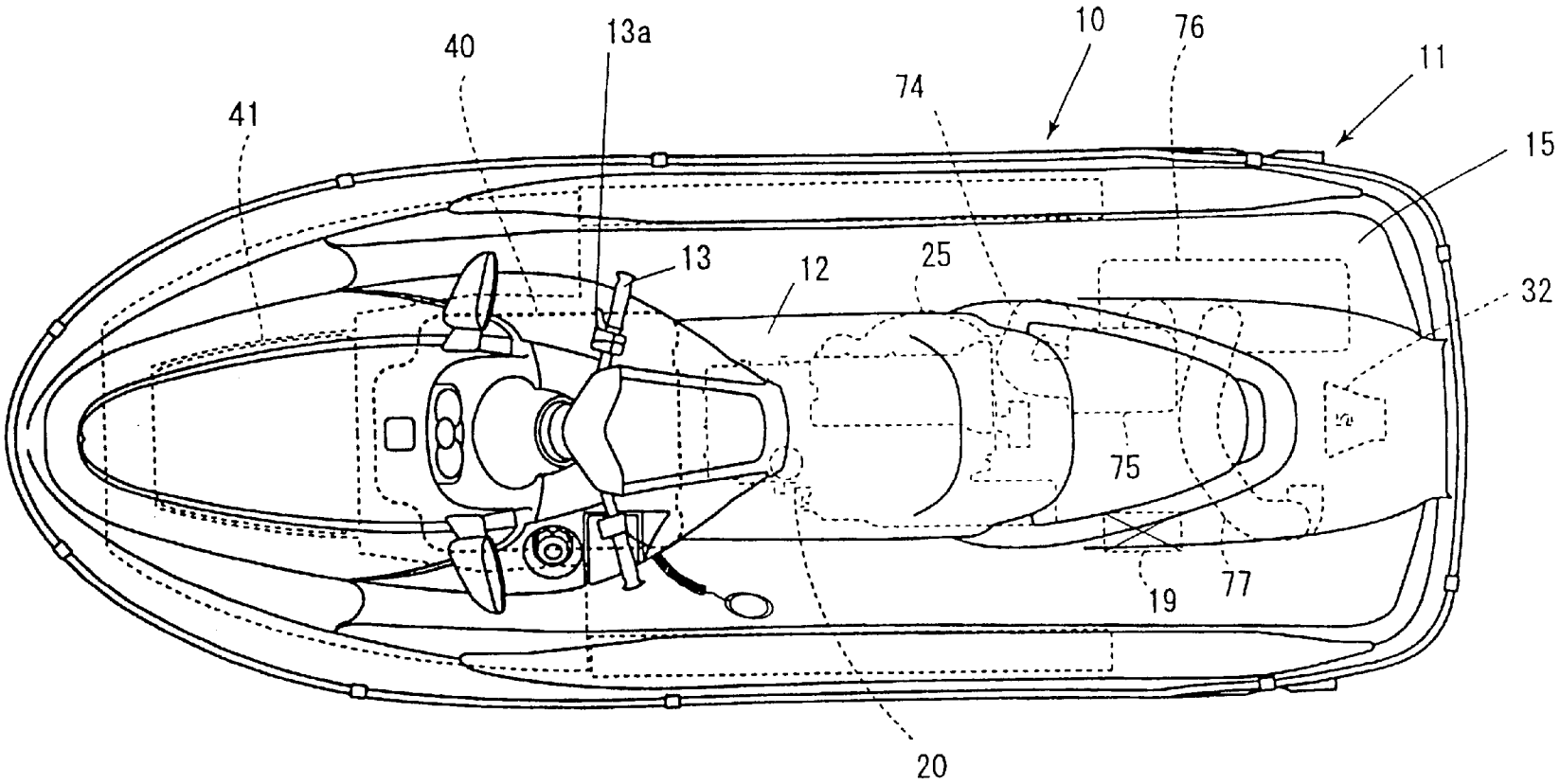
FIG. 2 is a plan view of the personal watercraft in FIG. 1.
Figure 3:
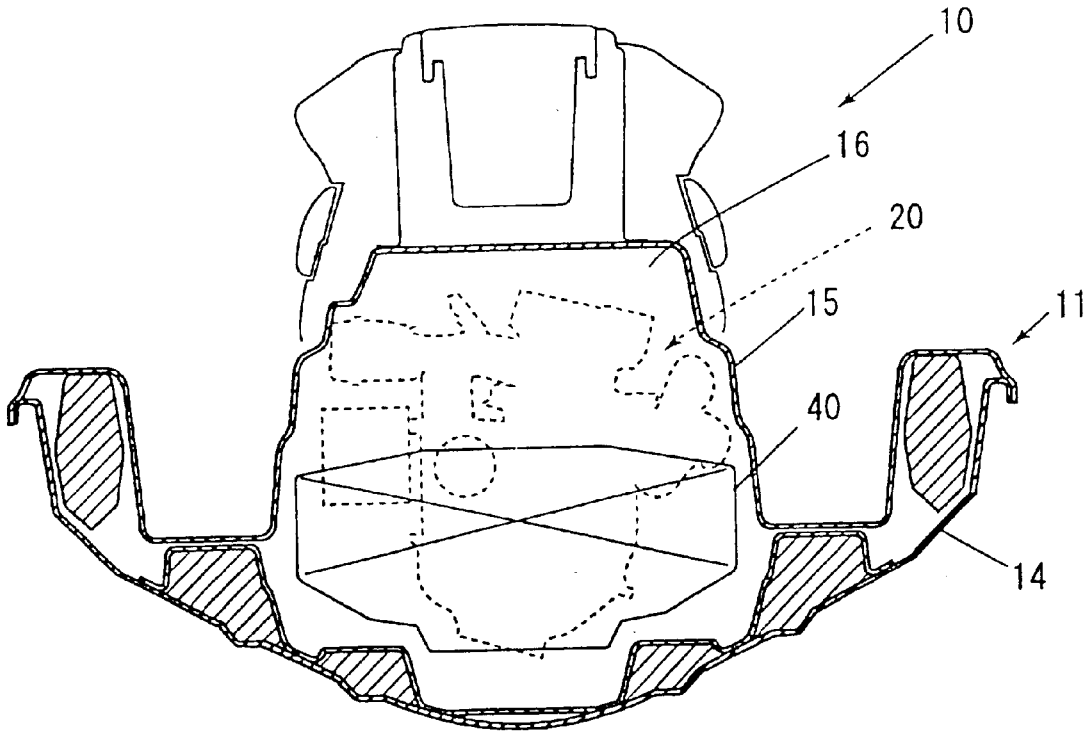
FIG. 3 is a partial enlarged sectional view (partly omitted sectional view) taken along line III—III of FIG. 1.

FIG. 1 is a schematic side elevational view showing an example of a personal watercraft which employs an embodiment of an engine mount structure for a personal watercraft according to the present invention, FIG. 2 is a plan view of the same, and FIG. 3 is a partial enlarged sectional view (partly omitted sectional view) taken along line III—III of FIG. 1.

As shown in the figures (principally in FIG. 1), this personal watercraft 10 is a small vessel of the saddle type, and a driver can sit on a seat 12 on a body 11 and grip a steering handle 13 with a throttle lever to steer the personal watercraft 10.

The body 11 has a floating body structure wherein a hull 14 and a deck 15 are joined together such that a space 16 is formed in the inside thereof. In the space 16, an engine 20 is mounted on the hull 14 such that a crankshaft 21 (refer to FIG. 6) thereof extends in a longitudinal direction of the body 11, and a jet pump (jet propulsion pump) 30, as propulsion means which is driven by the engine 20, is provided at a rear portion of the hull 14.

Intake ducts 18 and 19 for supplying intake air into the body (space 16) are provided on the body 11.

The jet pump 30 has a passage 33 extending from an intake 17 open to the bottom to a jet outlet 31 and a nozzle 32 open to the rear end of the body and an impeller 34 disposed in the passage 33, and a shaft 35 of the impeller 34 is connected to an output power shaft, which is hereinafter described, of the engine 20 through a coupling 80. Accordingly, if the impeller 34 is driven by the engine 20, then water taken in from the intake 17 is jetted from the nozzle 32 through the jet outlet 31 so that the body 11 is propelled. The driving speed of the engine 20, that is, the propelling force by the jet pump 30, is controlled by a pivoting operation of a throttle lever 13*a* (refer to FIG. 2) of the steering handle 13 described above. The nozzle 32 is operatively associated with the steering handle 13 by an control wire (not shown) such that it is pivoted by an operation of the steering handle 13, and the advancing direction can be changed thereby. Reference numeral 40 denotes a fuel tank, and 41 an accommodation chamber.

Figure 4:
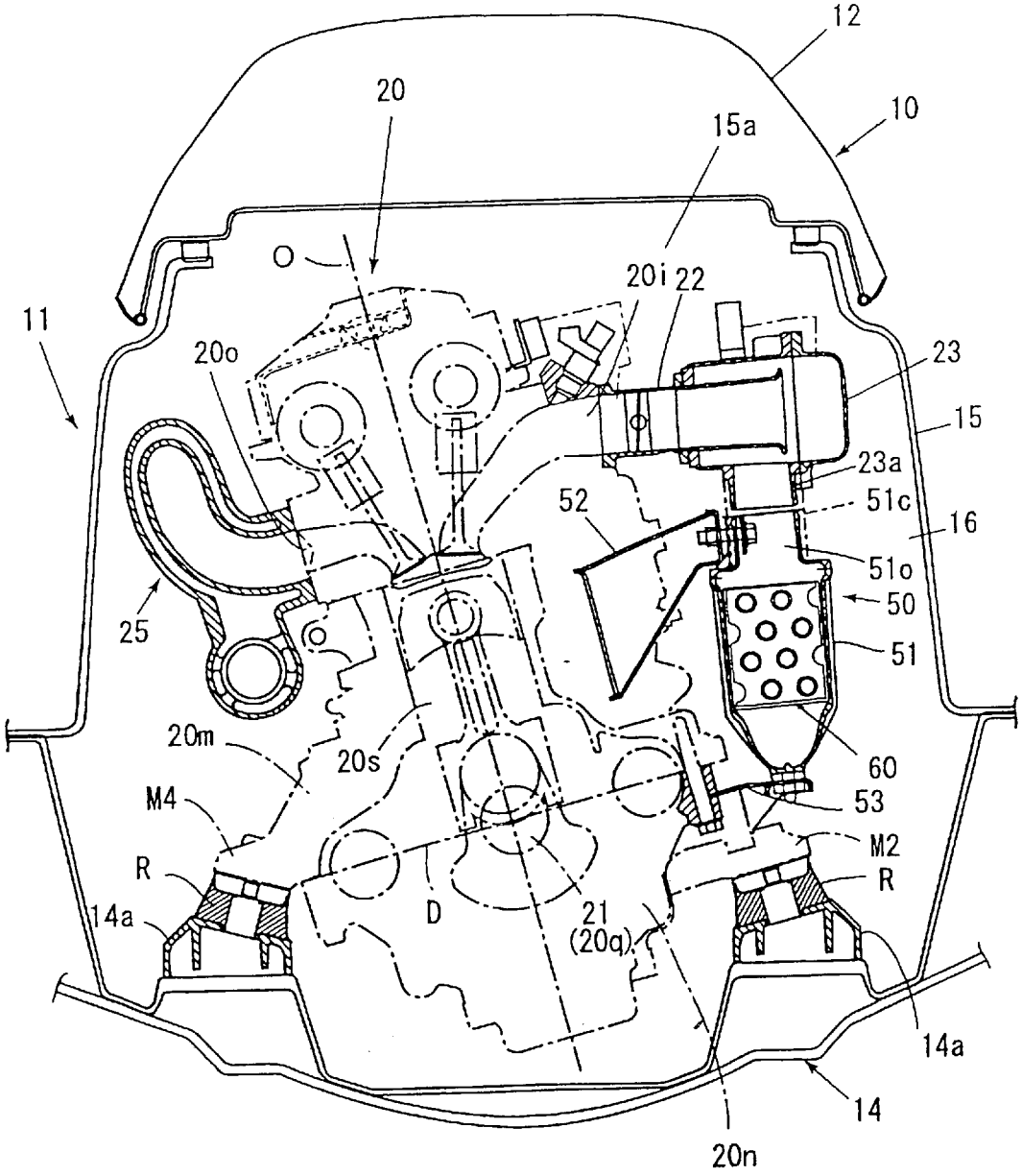
FIG. 4 is a partial enlarged sectional view (partly omitted sectional view) taken along line IV—IV of FIG. 1.
Figure 5:
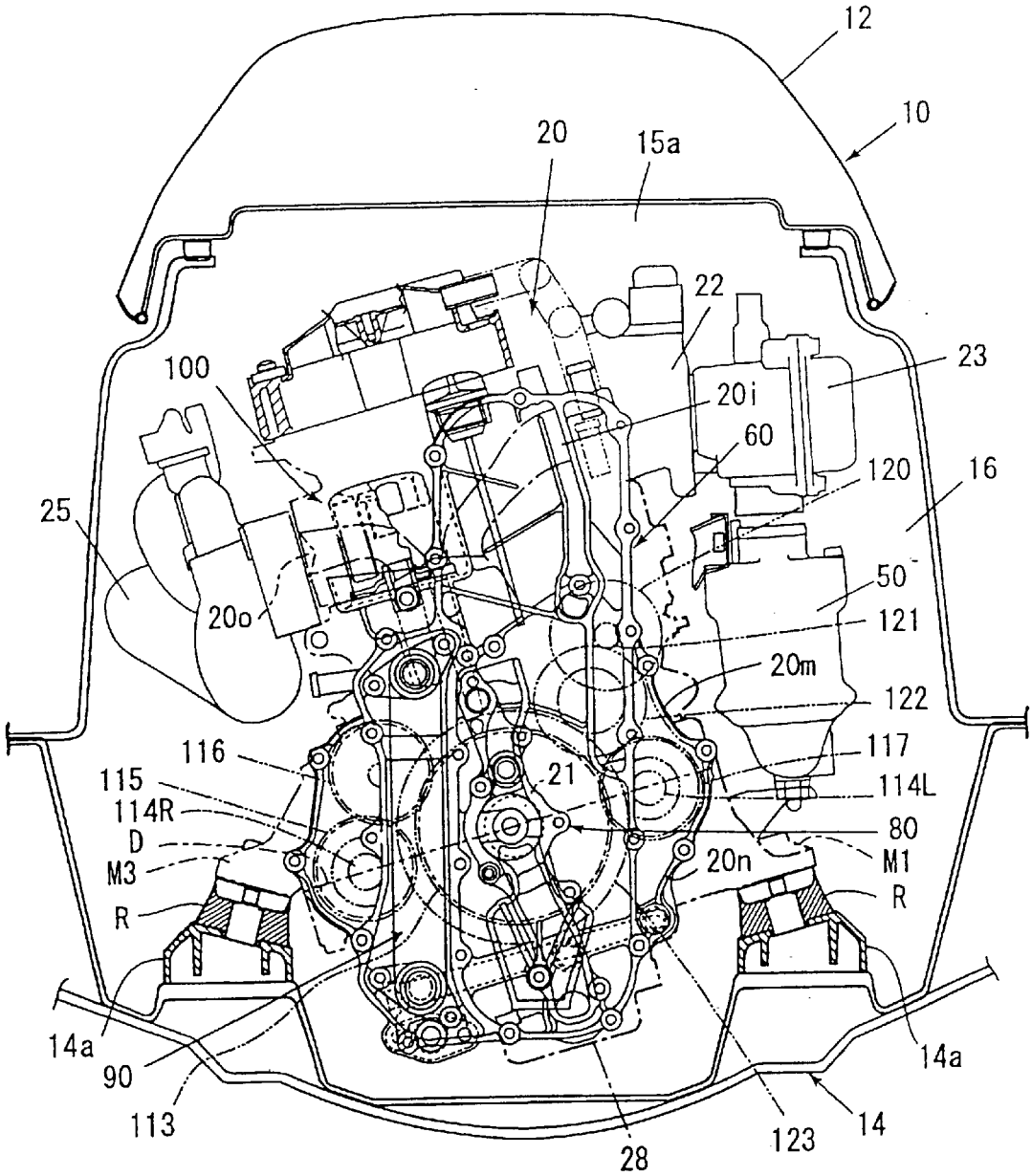
FIG. 5 is a partial enlarged sectional view (partly omitted sectional view) taken along line V—V of FIG. 1.
Figure 6:
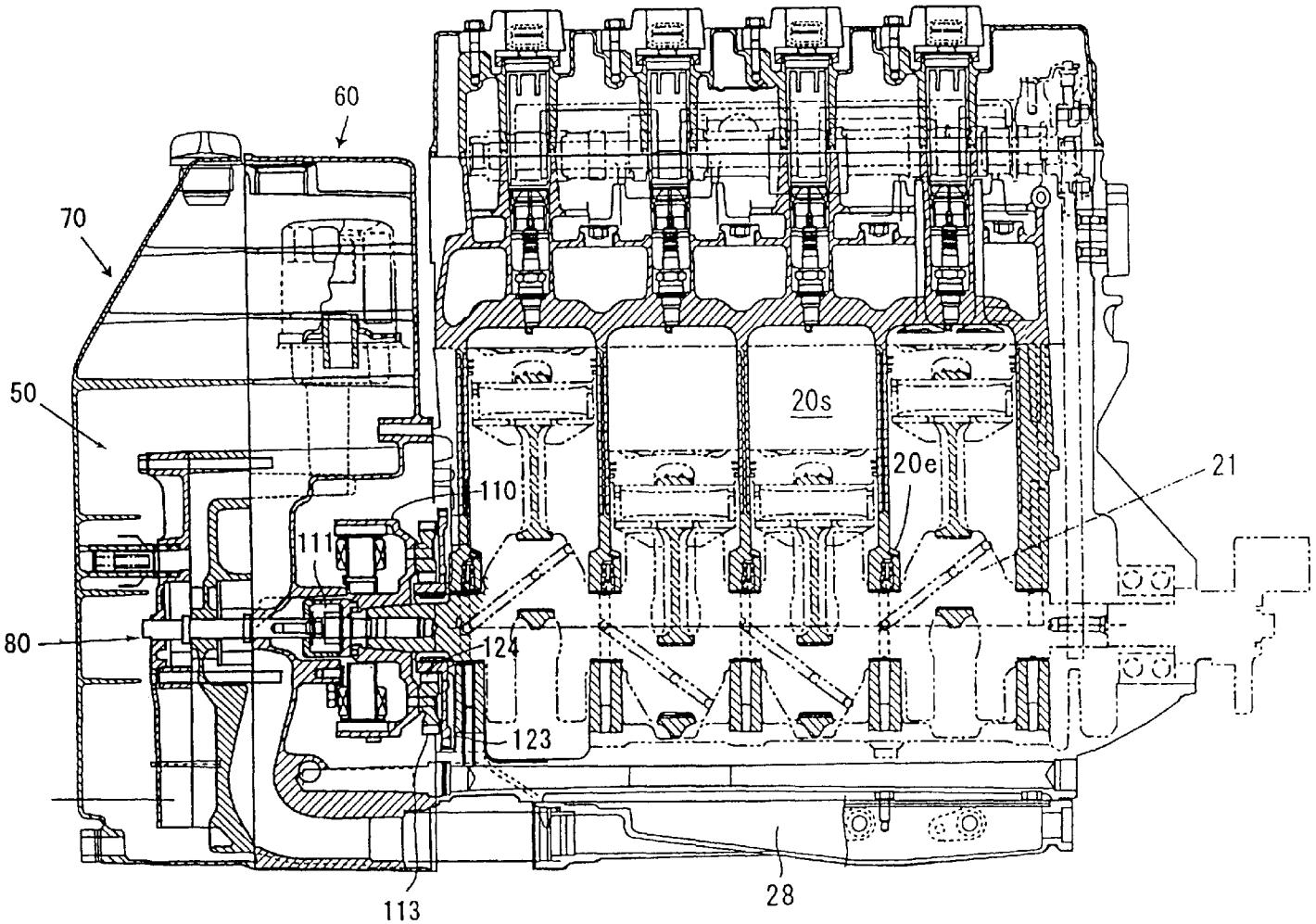
FIG. 6 is a right side elevational view of the engine.
Figure 7:
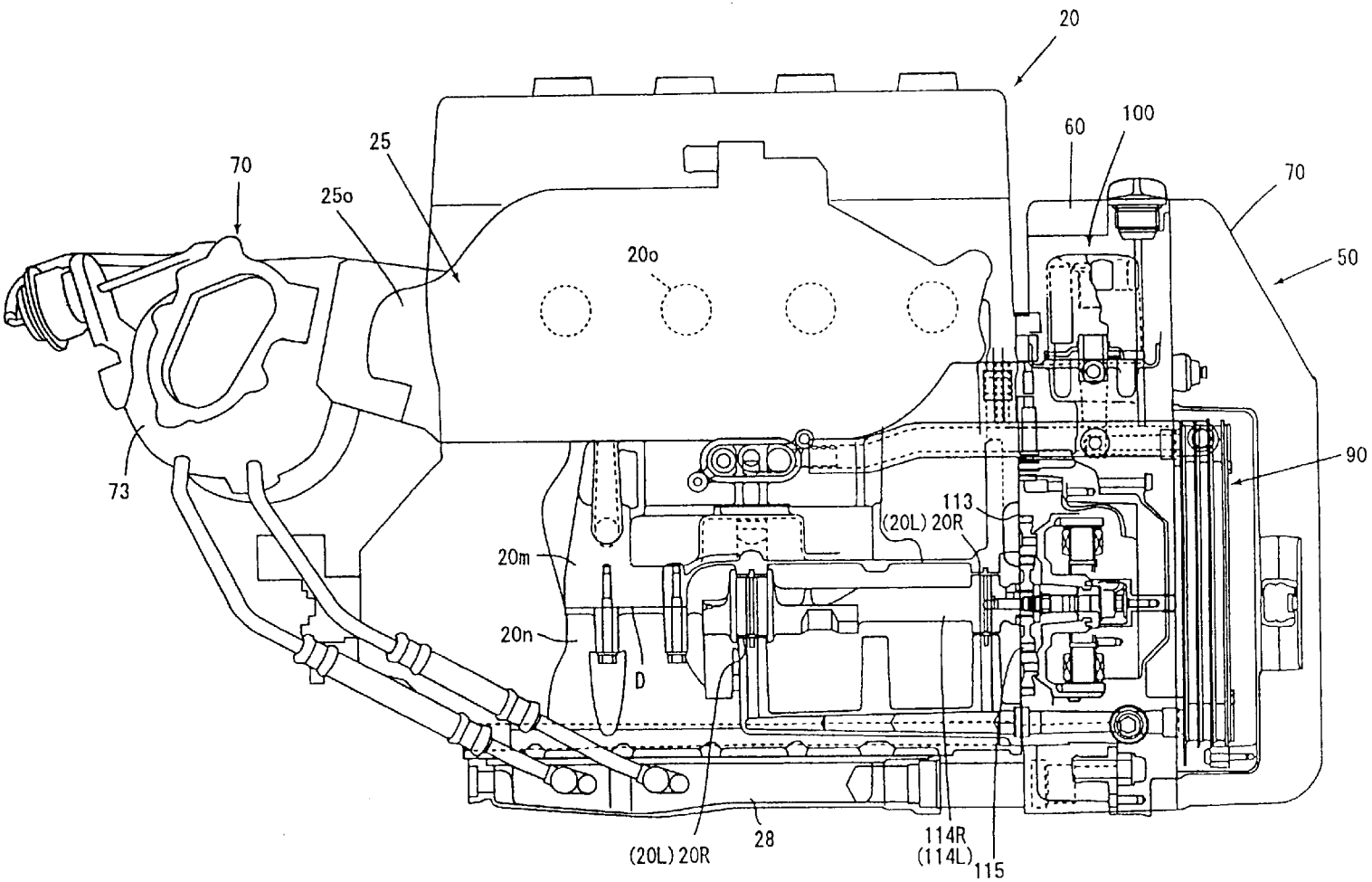
FIG. 7 is a left side elevational view (partial sectional view) of the engine.
Figure 8:
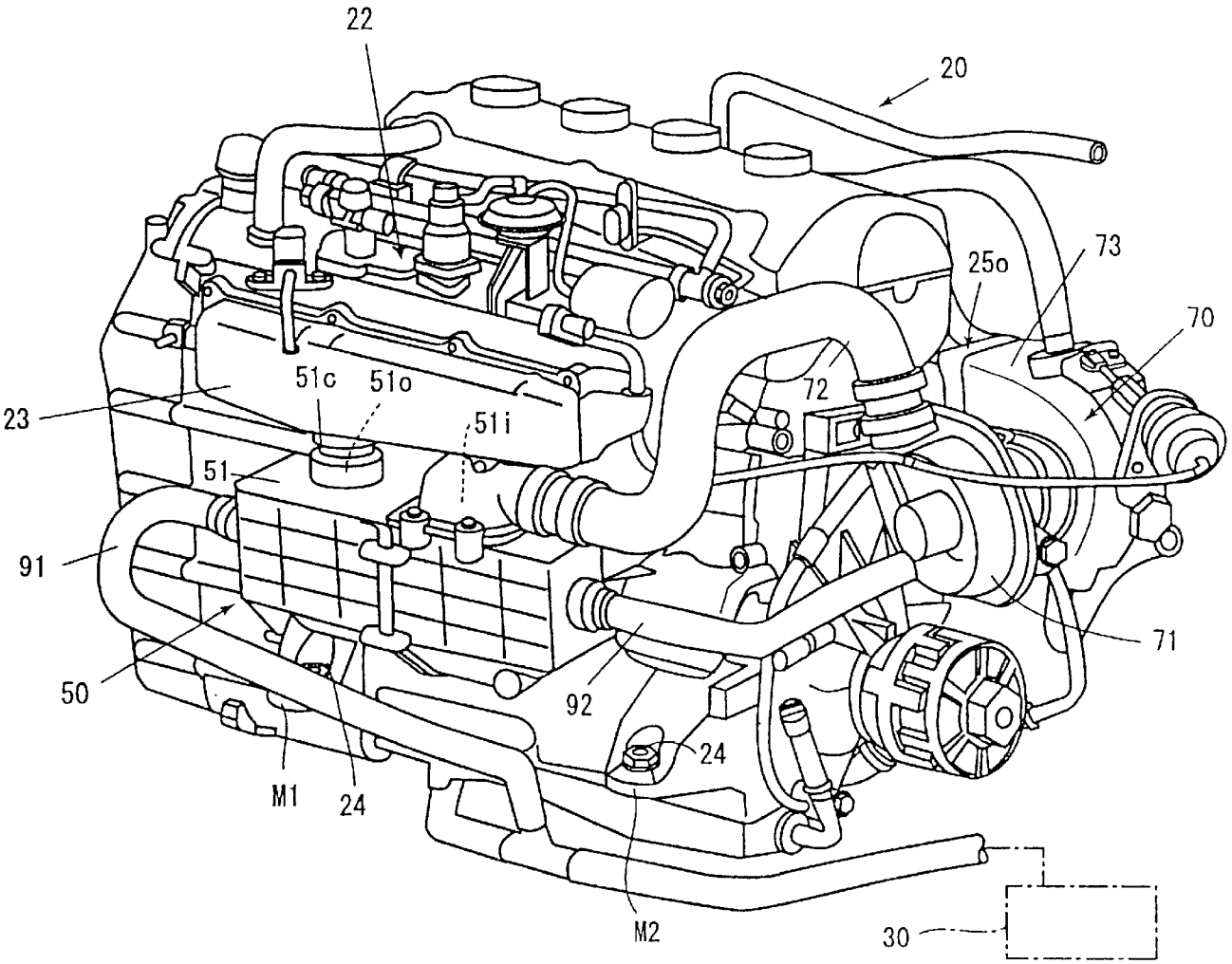
FIG. 8 is a schematic perspective view of the engine as viewed obliquely from the rear.

FIGS. 4 and 5 are views principally showing the engine 20, and FIG. 4 is a partial enlarged sectional view (partly omitted sectional view) taken along line IV—IV of FIG. 1 and FIG. 5 is a partial enlarged sectional view (partly omitted sectional view) taken along line V—V of FIG. 1. FIG. 6 is a right side elevational view of the engine 20, FIG. 7 is a left side elevational view (partial sectional view) of the engine 20, and FIG. 8 is a schematic perspective view of the engine 20 as viewed obliquely from the rear.

The engine 20 is a DOHC in-line four-cylinder dry sump four-cycle engine and is disposed such that the crankshaft 21 thereof extends in the forward and rearward direction of the body 11 as shown in FIGS. 1 and 6. Further, as shown in FIG. 4, the engine 20 is mounted in a state of inclination wherein a plane O extending between the top and bottom of the engine through the crankshaft is inclined to one side (in this instance, in the counterclockwise direction) about the crankshaft 21.

As shown in FIGS. 4 and 5, an intake opening (intake port) 20*i* is disposed on the left side of the engine 20 with respect to the advancing direction of the body 11, and an exhaust opening (exhaust port) 20*o* is disposed on the right side of the engine 20. A throttle body 22 and a surge tank (intake chamber) 23 are connected to the intake port 20*i*, and an intercooler 50 is connected to and disposed just below the surge tank 23. In FIG. 4, reference numerals 52 and 53 denote each a mounting bracket of the intercooler 50 to the engine 20.

The intercooler 50 includes a case 51 having an intake entrance 51*i* connected to and communicated with a compressor section 71 of a supercharger (turbocharger) 70 disposed directly rearwardly of the engine 20 by a pipe 72 and an exit 51*o* connected to the intake entrance 23*a* of the surge tank 23 described above by a tube 51*c*, and a cooling unit 60 which is a heat exchanging unit accommodated in the case 51. Referring to FIG. 8, reference numerals 91 and 92 denote each a cooling water hose connected to the intercooler 50.

An exhaust manifold 25 is provided for the exhaust port 20*o* of the engine 20 as shown in FIGS. 4 and 5, and an exhaust exit 25*o* (refer to FIG. 8) of the exhaust manifold 25 is connected to a turbine section 73 of the turbocharger 70. Exhaust gas having rotated a turbine in the turbine section 73 passes through the pipe 74, a backflow preventing chamber 75 for preventing a backflow of water (admission of water into the turbocharger 70 and so forth) upon capsize, a water muffler 76 and an exhaust-drain pipe 77 and is exhausted into a water stream produced by the jet pump 30.

Figure 9A:
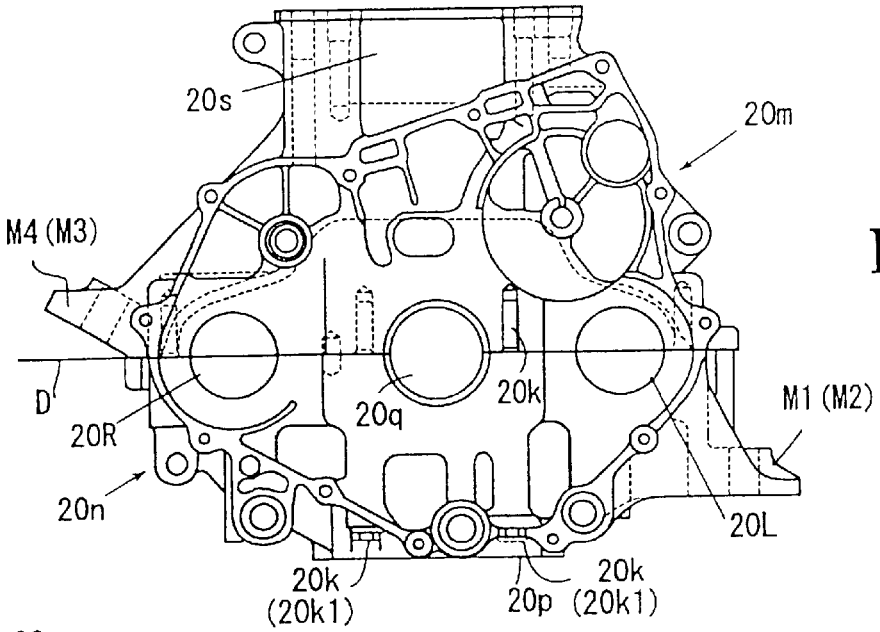
FIG. 9(*a*) is a front elevational view of the engine block.
Figure 9B:
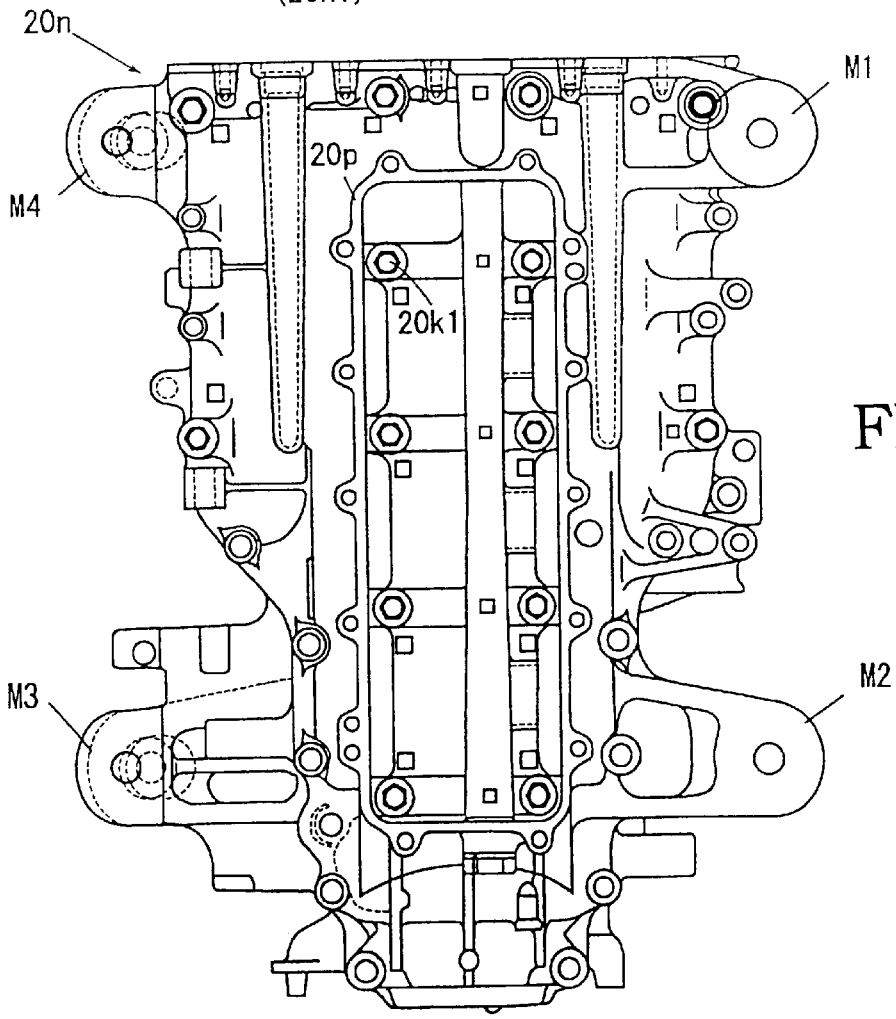

As shown in FIG. 9, the engine 20 has an upper case 20*m* and a lower case 20*n* which are divided along a divisional plane D. A bearing hole 20*q* for the crankshaft 21 and bearing holes 20L and 20R for balancers which are hereinafter described are formed by fastening the cases 20*m* and 20*n* to each other using fastening bolts 20*k*. A lowermost face 20*p* of the lower case 20*n* is positioned below head portions 20*k*1 of the fastening bolts 20*k* and presents a joining or mounting face 20*p* for oil pan 28 (refer to FIGS. 5 and 6). The mounting face 20*p* for the oil pan 28 is formed in an elongated rectangular frame shape as viewed in bottom plan ((b) of FIG. 9) surrounding and near to the fastening bolts 20*k*. An upper face of the oil pan 28 is open so as to conform to the joining face 20*p* of the lower case 20*n*.

As clearly shown in FIG. 9, and as shown also in FIGS. 4 and 5, four mount portions M1, M2, M3 and M4 of the engine 20 on the body 11 are provided on left and right sides of the engine on the upper case 20*m* and the lower case 20*n*. In particular, the front and rear mount portions M1 and M2 on the left side with respect to the advancing direction of the body are formed integrally on the lower case 20*n*, and the mount portions M3 and M4 on the right side with respect to the advancing direction of the body are formed integrally on the upper case 20*m*.

The mount portions M1, M2, M3 and M4 are fastened to mounting surfaces on mount-receiving portions 14*a* provided on the hull 14 by means of bolts 24 (refer to FIG. 8), each with a mount rubber member R interposed therebetween, and the engine 20 is installed in the body 11 thereby.

As apparent also from FIG. 4, the engine 20 is attached in an inclined relationship such that the intake port 20*i* side thereof is positioned on the side that faces obliquely upwardly, and the exhaust port 20*o* side thereof is positioned on the side that faces obliquely downwardly. The mount portions M1 and M2 on the intake port 20*i* side are provided on the lower case 20*n*, and the mount portions M3 and M4 on the exhaust port 20*o* side are provided on the upper case 20*m*. Above the mount portions M1 and M2 on the intake port 20*i* side, the intercooler 50 connected to the supercharger 70 and the surge tank 23 are disposed as described above. Further, as shown in FIG. 5, a starter motor 120 for starting the engine is attached to the upper case 20*m*, and the mount portions M1 and M2 on the side on which the starter motor 120 is attached are provided on the lower case 20*n*.

As shown in FIG. 5, a pinion gear 121 of the starter motor is held in meshing engagement with a starter gear 123 with a speed reducing gear 122 interposed therebetween. The starter gear 123 is connected to a balancer driving gear 113 through a one-way clutch 124 as shown in FIG. 6. The balancer driving gear 113 is disposed on an outer periphery of the one-way clutch 124 and is secured to the rear face of an ACG rotor 110.

As shown in FIG. 5, the balancer driving gear 113 is held in meshing engagement through an idle gear 116 with a balancer gear 115 secured to an end of a balancer 114R (refer to FIG. 7) disposed in parallel to and to the right of the crankshaft 21 (on the left side in FIG. 5) inside of the engine 20 to drive the balancer 114R. Simultaneously, since the balancer driving gear 113 is held in direct engagement with a gear 117 secured to an end of another balancer 114L disposed in parallel to and to the left of the crankshaft 21 (on the right side in FIG. 5) inside of the engine 20, it drives the balancer 114L to rotate in a direction reverse to that of the rotation of the balancer 114R. The left and right balancers 114L and 114R are disposed on the left and the right of the crankshaft 21 on the transverse plane D at which the upper case 20*m* and the lower case 20*n* are joined, and are supported for rotation in the bearing holes 20L and 20R described hereinabove.

The axial line of the starter motor 120 and the axial lines of the balancers 114L and 114R are disposed in parallel to each other, and the idle gear 116 of the balancer 114R is disposed on the opposite side to the starter motor 120 with respect to the crankshaft 21 and is disposed on the opposite side to the starter motor 120 with respect to a cylinders 20*s* (refer to FIG. 4 and (a) of FIG. 9).

As shown in FIGS. 5 to 7, an oil tank 50, an oil pump 80 and an oil cooler 90 are provided integrally with each other on an extension line of the crankshaft 21 at a front portion of the engine 20. The oil pump 80 and the oil cooler 90 are provided in the oil tank 50. Further, an oil filter 100 is provided at an upper portion of the oil tank 50.

The oil tank 50 is formed from a tank body 60 joined to the front face of the engine 20 and a cover 70 joined to a front face of the tank body 60. The ACG rotor 110, a coupling 111 for driving the oil pump 80, the balancer driving gear 113, the balancer gear 115, the idle gear 116, the balancer gear 117, the pinion gear 121 of the starter motor 120, the speed reducing gear 122, and the starter gear 123 are covered with a rear portion of the tank body 60.

With the engine mount structure for a personal watercraft having such a configuration as described above, the following operation and effects are achieved.

(a) The engine 20 for driving the jet propulsion pump 30 is incorporated in the body 11 surrounded by the hull 14 and the deck 15, and the engine 20 has the upper case 20*m* and the lower case 20*n* which are joined along the transverse plane D parallel to the crankshaft 21 of the engine 20 and is mounted in a state wherein it is inclined to one side around the crankshaft 21. The mount portions M1, M2, M3 and M4 of the engine 20 on the body 11 are provided at the left and right sides of the engine on the upper case 20*m* and the lower case 20*n*. Therefore, the engine 20 can be incorporated in a well-balanced condition in the body 11 in the state wherein it is inclined to one side about the crankshaft 21 thereof.

Further, since the mount portions M1, M2, M3 and M4 can be made compact, ancillary mechanisms (for example, the starter motor 120) or parts for the intake and exhaust systems (for example, the throttle body 22, surge tank 23, exhaust manifold 24 or the like) can be accommodated utilizing the small and precious intra-body space 16 effectively.

(b) Since the engine 20 is mounted in an inclined state such that the intake port 20*i* side thereof is positioned on the upper side and the exhaust port 20*o* side is positioned on the lower side and, the mount portions M1 and M2 on the intake port 20*i* side are provided on the lower case 20*n* and the mount portions M3 and M4 on the exhaust port 20*o* side are provided on the upper case 20*m*, the space above the mount portions M1 and M2 on the lower case 20*n* side is wide and equipment for the intake system (such as the surge tank 23 or the oil tank 50) or a member (for example, the pipe 92) can be accommodated effectively making use of the space.

Particularly where the engine 20 is an engine with a supercharger and the intercooler 50 connected to the supercharger 70 and the surge tank 23 are connected to the intake port 20*i* of the engine 20, as in the present embodiment, the intercooler 50 and the surge tank 23 can be readily accommodated making use of the wide space above the mount portions M1 and M2 on the lower case 20*n* side.

Accordingly, such an engine mount structure as described above is particularly effective where the engine is provided with a supercharger.

(c) Since the starter motor 120 for starting the engine 20 is provided on the upper case 20*m* and the mount portions M1 and M2 on the side on which the starter motor 120 is mounted are provided on the lower case 20*n*, the starter motor 120 can be disposed close to the engine 20 without interfering with the mount portions M1 and M2.

Accordingly, the engine weight including the starter motor 120 can be concentrated in the proximity of a central portion of the body 11, and the cornering performance of the boat 10 can be optimized.

(d) Since the mounting face 20*p* for the oil pan 28 surrounds and is near to the fastening bolts 20*k* for fastening the upper case 20*m* and the lower case 20*n* of the engine 20 to each other, the overall height of the engine 20 can be reduced.

In particular, if the mounting face 20*p* for the oil pan 28 is provided on the inner side of the fastening bolts 20*k* as viewed in bottom plan, then the capacity of the oil pan 28 becomes small, but if the mounting face 20*p* is provided on the outer side remotely from the fastening bolts 20*k*, then the width of the oil pan 28 is increased, which makes it difficult to make the oil pan 28 conform with the shape of the boat. Further, if the mounting face 20*p* for the oil pan is overlapped with the fastening bolts 20*k* as viewed in bottom plan, then the overall height of the engine becomes greater.

In contrast, with the present embodiment, since the mounting face 20*p* for the oil pan surrounds and is near to the fastening bolts 20*k*, as viewed in bottom plan, the overall height of the engine 20 can be reduced. And, the oil pan 28 can be provided while ensuring an appropriate capacity of the oil pan in conformity with the bottom of the boat and while ensuring an appropriate clearance from the body.

(e) Since the balancers 114L and 114R are disposed on the left and the right of the crankshaft 21 on the transverse plane D between the upper case 20*m* and the lower case 20*n*, with the engine 20, the overall height can be reduced even though the balancers 114L and 114R are employed.

Accordingly, the present engine 20 is suitably incorporated in the boat 10 having a small intra-body space 16 surrounded by the hull 14 and the deck 15, and also the center of gravity of the boat 10 can be set low.

Further, since the balancers 114L and 114R are disposed on the left and the right of the crankshaft 21 on the transverse plane D between the upper case 20*m* and the lower case 20*n* and parallel to the crankshaft 21, the position of the crankshaft 21 can be set relatively low, and the shaft 35 of the jet propulsion pump 30 can be connected on an extension line of the crankshaft 21.

Furthermore, since a space is provided on the opposite sides of the cylinders 20*s* as a result of positioning the left and right balancers 114L and 114R on the left and the right of the crankshaft 21 on the plane D, the degree of freedom in arrangement of ancillary mechanisms can be ensured.

In particular, the engine 20 for a personal watercraft can be suitably incorporated in the personal watercraft 10, the center of gravity of the boat 10 can be set low and freedom in arrangement of ancillary mechanisms can be achieved.

(f) Since the balancer driving gear 113 for the balancers is provided in a closely contacting relationship on the rear face of the ACG rotor 110 provided at an end portion of the crankshaft 21, the driving system for the balancers 114L and 114R can be made compact, and also the overall length of the engine 20 can be made short.

(g) Since the one-way clutch 124 of the engine starting system is provided on the rear portion of the ACG rotor 110 and the balancer driving gear 113 for the balancers is provided on an outer periphery of the one-way clutch 124, the overall length of the engine 20 can be reduced further by an amount by which the one-way clutch 124 of the starting system and the balancer driving gear 113 for the balancers overlap with each other.

(h) Since the oil tank 50 covers the ACG rotor 110, the balancers 114 (L, R) and the driving chamber of the starter motor 120, the need for provision of a separate cover is eliminated and the overall length of the engine 20 can be further reduced. In addition, noise is reduced by the sound-absorbing effect of the oil in the oil tank 50.

(i) Since the starter motor 120 and the balancers 114L and 114R are disposed in parallel to each other and the idle gear 116 of the balancer 114R is disposed on the opposite side to the starter motor 120 with respect to the crankshaft 21, the starter motor 120 and the driving system for the balancers can be disposed in a compact arrangement around the crankshaft. As a result, the center of gravity of the engine 20 can be set low, and also the center of gravity of the entire boat 10 can be set low.

(j) Since the idle gear 116 of the balancer 114R is disposed on the opposite side to the starter motor 120 with respect to the cylinders 20*s* of the engine, the starter motor 120 and the driving system for the balancers can be disposed in a compact arrangement near the vertical axis of the engine.

Accordingly, the engine weight including the starter motor 120 and the driving system described above can be concentrated in the proximity of a central portion of the body 11, and the cornering performance of the boat 10 can be enhanced.

While an embodiment of the present invention is described above, the present invention is not limited to the embodiment described above but can be carried out suitably in various forms within the scope of the subject matter of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine mount structure for a personal watercraft wherein an engine for driving a jet propulsion pump is mounted within a body of the watercraft having a hull and a deck, the engine (1) provided with a supercharger, an intercooler connected to the supercharger and a surge tank (2) having an upper case and a lower case that are joined along a transverse plane parallel to a crankshaft of the engine and (3) being mounted within the watercraft body in a state of inclination to one side about said crankshaft, whereby the inclination of the engine presents one side thereof facing obliquely upwardly and presents the other side thereof facing obliquely downwardly; the engine mount structure comprising:

mount portions provided on both sides of the engine for fastening to mounting surfaces within the watercraft body, the mount portions on one side of the engine being joined to the lower case, and the mount portions on the other side of the engine being joined to the upper case;

the mount portions joined to the lower case being positioned on the upwardly facing side of the engine;

the mount portions joined to the upper case being positioned on the downwardly facing side of the engine;

an intake port provided on the upwardly facing side of the engine;

the intercooler and the surge tank being connected to the intake port; and;

an exhaust port provided on the downwardly facing side of the engine.

2. An engine mount structure according to claim 1, wherein a starter motor for starting the engine is attached to the upper case on the upwardly facing side of the engine.

* * * * *